US005819986A

United States Patent [19]

Last et al.

[11] Patent Number: 5,819,986

[45] Date of Patent: Oct. 13, 1998

[54] LIQUID DISPENSER WITH REFILL PACKING

[75] Inventors: Laurens Last, Zandvoort; Michiel Stokhuyzen, The Hague, both of Netherlands

[73] Assignee: ITSAC N.V., Curacao, Netherlands Antilles

[21] Appl. No.: 702,545

[22] PCT Filed: Mar. 6, 1995

[86] PCT No.: PCT/NL95/00082

§ 371 Date: Sep. 6, 1996

§ 102(e) Date: Sep. 6, 1996

[87] PCT Pub. No.: WO95/24972

PCT Pub. Date: Sep. 21, 1995

[30] Foreign Application Priority Data

Mar. 7, 1994 [NL] Netherlands ..... 9400346

[51] Int. Cl.[6] ..... B65D 35/28

[52] U.S. Cl. ..... 222/95; 222/105; 222/383.1

[58] Field of Search ..... 222/95, 96, 105, 222/383.1

[56] References Cited

U.S. PATENT DOCUMENTS 4,624,413 11/1986 Corsette ..... 222/383.1
5,556,005 9/1996 Banks ..... 222/105
5,577,638 11/1996 Takagawa ..... 222/105

FOREIGN PATENT DOCUMENTS 4303558 8/1993 Germany ..... 222/105
91/14630 10/1991 WIPO .

*Primary Examiner*—Joseph Kaufman
*Attorney, Agent, or Firm*—Foley & Lardner

[57] ABSTRACT

A dispenser for liquid, gel, granular or powdered media, comprising an outer container of rigid material in which a suction pump is operated by a trigger mechanism. A pump outlet is connected via a flexible tube to a spray nozzle, and via a suction tube to a connector tube. A refill packing is provided within the outer container and includes an integrally manufactured connector that can be pressed onto the connector tube. The connector tube opens the connector upon insertion thereinto. A special plug, including guide arms, ensures that the connector opens upon insertion of the connector tube, and closes again upon withdrawal of the connector tube from the connector. The connector/connector tube assembly provides leak-free connection of the refill packing within the outer container.

16 Claims, 6 Drawing Sheets

LIQUID DISPENSER WITH REFILL PACKING

BACKGROUND OF THE INVENTION

The invention relates to a liquid dispenser with refill packing, comprising an openable outer container of stiff material being provided with an externally operable dispenser pump or atomizing pump, to which a nozzle is connected at the delivery side and a connector tube at the intake side, and an inner container of flexible material executed as a flexible refill packing for a liquid to be dispensed, closed off by a plug member being connectable to the connector tube and openable by pressing it. With such a liquid dispenser, liquids are understood to mean not only pure liquids such as aqueous solutions, alcohols, oils and the like, but also liquid materials having a higher viscosity, such as gels, jellies and the like, as they are used in e.g. the cosmetics industry, foods, detergents and pharmaceutical industry, and also gaseous media as well as atomizable powder or granular material.

A liquid dispenser of the above-mentioned type is known from the international patent application WO 91/14630. There, the dispenser consists of a foldable outer container of an elongated type, being closed off and retained by a screw-on washer at the top side, to which a spray nozzle is secured that contains a dispenser pump provided with an external trigger, to which a spray nozzle is connected. Protruding in the washer, a tube communicating with the inlet of the dispenser pump is connected to said spray nozzle. A flexible refill packing, filled with a liquid to be dispensed can be fitted in the outer container. Such a refill packing is a bag-shaped packing of flexible plastic material, closed off by a plug being provided with an engaging groove at its outer side. This plug has a central hollow bore being closed off liquid-tight by a membrane. On use, such a refill packing is fitted in the folded-open outer container, that is subsequently closed, in which two special engaging rims engage into the groove at the outer circumference of the plug, so that the fitted refill packing is fixed. Subsequently, the washer with spray nozzle is screwed on, thereby pushing the tube downward against the plug, whereupon in pushing the tube end down further, a cutting edge formed thereon cuts through the membrane, so that an open connection being closed to the outside is established between dispenser pump and the interior of the refill packing.

In an alternative embodiment, the connecting tube is fitted to one of the inner side walls of the outer container and connected to the spray nozzle by means of a hose.

This known liquid dispenser with refill packing has the drawback, that after having been connected to the connector tube of the dispenser, the refill packing has been definitively and irrevocably opened, so that the packing can be removed only after it has been completely emptied. If one would wish to change the liquid while using the dispenser, this is possible only after the packing containing the first liquid has been completely consumed. Even on removing completely consumed refill packings from the dispenser, there is still the possibility that residual liquid will leak through the opened plug. A further drawback is the fact, that after manufacture, the flexible refill packings have to be filled first, before the terminal plug can be fitted onto it.

It is the object of the invention to provide a liquid dispenser with refill packing, in which these drawbacks have been removed.

It is a further object of the invention to provide a connector system that can be used therewith.

The invention also has the object of providing a refill packing, closed by a connector, that can be filled after the connector has already been fitted.

According to the invention, a liquid dispenser with refill packing as defined in the preamble is provided, characterized in that the connector tube is constructed as a hollow pin narrowing at its extreme end, said extreme end having a profiled plug head, with lateral openings being made in the tube wall in the pin extremity closely below the plug head, and that the plug member is a connector consisting of a connector body having a central through-bore in which the connector pin can be inserted, and that can be closed at its back side by a plug inserted clampingly in a seat formed in the rear end of the bore, or by a sealingly inserted plug having a profile corresponding to the seat, said plug being provided with a profiled plug cavity in which the plug head fits, and that the connector body is connected to the plug by bending or pivoting guide arms holding the plug fixed in the opened position, in which the plug is free of the bore, said position being reachable by inserting the connector pin from the outside into the bore of the connector body and pushing it through.

The invention efficiently employs the guide arms, by which the plug is guided in its movement in relation to the connector body. In the first position, the plug is pressed into the rear side of the bore, or into the connector body seat. If a refill packing provided with such a connector is inserted into the outer container of the liquid dispenser, and the connector is pressed against the connector pin, the profiled plug head of the connector pin is suitably pressed into the correspondingly profiled cavity of the plug, whereupon by pushing further, the plug will come loose from the bore of the connector body, and is brought into the second position, in which there is a liquid connection between the lateral openings in the connector pin and the interior of the flexible inner container designed as a refill packing. Owing to the fact, that the connector pin fits tightly in the bore of the connector body, it is provided for, that no leakage can occur through it. Furthermore, the connector pin can efficiently be provided with an external groove plus O-ring, that guarantees a liquid-tight sealing on sliding the connector pin into the connector bore at all times.

The invention employs a connector system, in which the connector is represented by a connector body having a central through-bore that can be closed off by a plug provided with a cavity respresenting a receiving cavity for the head of a connector pin being put into the bore of the connector body from the outside and pushing the plug backwards in order to open the connector connection. Such a system is known from the international application WO 93/07084. This concerns a connector system which is meant in particular for filling a liquid dispenser from a storage bottle containing this liquid. There, the neck of the bottle is provided with a cork having an open cylinder in the middle, with a plug being inserted therein and being designed as a counter plug for the leading end of a plug-shaped connector tube being connected to the dispenser. For filling, the bottle is placed on the bottle neck upside down and is pushed through, as a result of which the plug is pushed upwards beyond the cylinder by the connector tube head fitting in the plug, in which, just like with the present invention, lateral openings enable liquid from the bottle to run through into the dispenser. According to this known embodiment, the profile of the connector tube head and the cavity of the plug of the cork have been chosen such, that on inserting the connector tube into the cork, the plug remains fixed on the connector tube head, when the plug is pushed out of the hollow cylinder in order to open the liquid connection, whereas, on withdrawing the connector tube again, the plug is drawn into the hollow cylinder again and resumes its sealing function there.

However, in this known embodiment there is the disadvantage, that such a system is particularly critical and that with the slightest amount of wear there is the risk that the grip between the connector tube head and the plug during opening and closing will be lost in an undesirable way, so that during and after filling there will be the risk of leakage.

Owing to the pivoting or bending guide arms according to the present invention, it is guaranteed, that opening and closing will take place in a reliable way under all circumstances.

The present invention has the added advantage that in its opened end position, the plug is fixed by the guide arms in such a way, that the plug head of the connector pin can be inserted into the plug cavity of the plug when the plug is in the opened position, c.q. the plug is not clamped in the connector body seat.

This property is also very important because due to this, the plug head of the connector pin of the filling device can be pushed into the plug cavity of the opened plug, so that subsequently, the connector can be closed off, without the plug being previously pushed into the connector body seat.

Furthermore, an advantage over existing connectors is that due to above-mentioned properties, the plug will never be able to move freely in the refill packing, and that the plug can be drawn into the seat by a plug head at all times, even after unintentional opening of the connector by external influences or incompetent use.

With the invention, the embodiment can further be such, that the connector body has upstanding columns at its back side, extending to beyond the plug and at their free ends being bridged by a rear edge, possibly provided with lateral pins providing for that a refill bag will not be sucked into the connector on pumping it out.

In case the guide arms are pivot arms, the upstanding columns can efficiently serve as their supports, so that then the plug is connected to the upstanding columns by pivoting guide arms.

Further, a very important advantage is that the connector body, movable plug included, can be manufactured integrally, just like the connector pin, which considerably reduces the total manufacturing costs.

For properly fastening the connector body to a flexible packing, a mounting edge can be efficiently provided at the outside of the connector body.

On mounting a flexible packing in a liquid dispenser as according to the previously mentioned international application WO 91/14630, the packing is connected with the plug directed upwards. This necessitates the mounting of guide pleats and/or a small riser to provide for, that the liquid can also be pumped out in already partly emptied fillings.

According to the invention, the liquid dispenser can be designed in such a way, that the connector pin is mounted in the outer container at the bottom side with the plug end directed upwards, and is connected to the dispenser pump through a flexible hose. Owing to this, it is achieved, that the liquid is always pumped out of the bag-shaped inner container from below, as a consequence of which auxiliary pleats and small riser can be withheld, and the refill bag is pumped out to a little ball. Such an embodiment further has the great advantage that the dispenser can be used in all positions (also upside down).

Another disadvantage of known liquid dispensers is that a separately mountable spray nozzle with pump is fitted thereon. This gives additional leakage possibilities and furthermore limits the freedom of design to a large extent.

According to the invention, there is provided a liquid dispenser in which possibly the outer container has an outlet branch integrally formed therewith, and the dispenser pump is positioned in a protected space of the inner container, and is connected to an outlet tube extending through the outlet branch. In this way, a compact and protected structure is obtained, which is also suitable for any desired external shape.

Further, the embodiment can efficiently be such, that the dispenser pump is a piston pump having a hollow piston rod with hollow piston connected to the outlet nozzle, and a pump cylinder being reciprocally movable over the piston rod, said pump cylinder being operated by a fork-shaped lever inserted into an engaging member, with the two fork ends of said lever being pivotably mounted to opposite wall portions of the outer container, and with the stem protruding outwards like a trigger through a slot in the container wall.

The embodiment can be particularly efficient in such a way, that the outlet branch integrally formed to the top side of the outer container is bent forward, that the trigger slot is provided at the front side of the outer container underneath the bend, and that at its rear side the outer container has a cover with a locking knob which is situated near the beginning of the outlet branch when the cover is closed, and represents a guiding aid for efficiently operating the trigger by hand during use.

BRIEF DESCRIPTION OF THE DRAWINGS

The invention is now further explained by means of an example with reference to the drawing. In the drawing.

DETAILED DESCRIPTION OF THE PREFERRED EMBODIMENT

Figure 1:
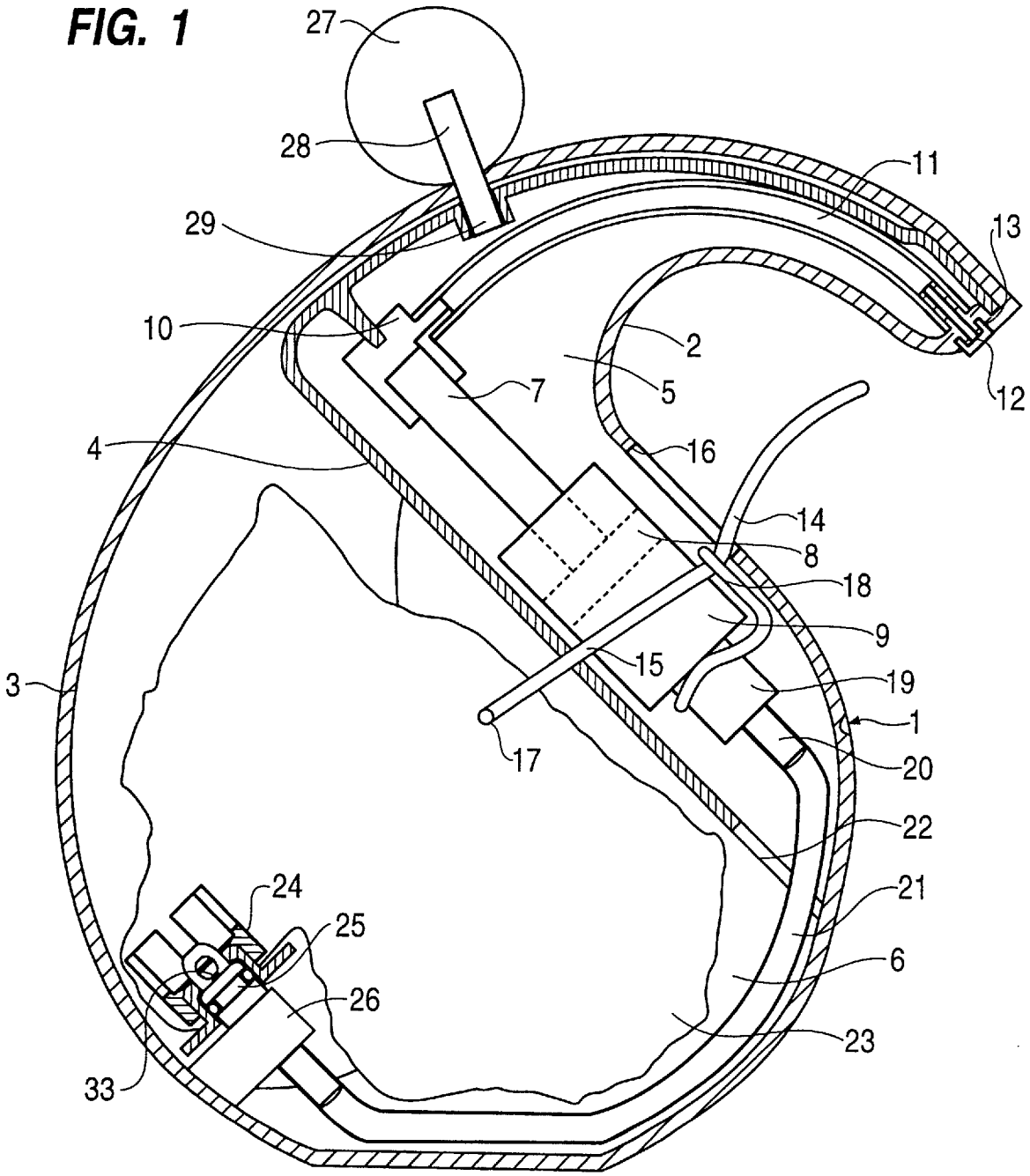
FIG. 1 shows a side view in section of an embodiment of a liquid dispenser according to the invention.

FIG. 1 shows in side view in section an embodiment of the liquid dispenser according to the invention. The dispenser has an outer container 1 of hard plastic material provided with a bent neck 2. The rear half of the container is represented by a cover 3 that can be taken off. In the container is further a partition wall part 4 providing for the separation between a pump housing 5 and reservoir housing 6. Both wall parts of the outer container and the partition wall were produced from hard plastic material by injection moulding.

A dispenser pump having a hollow piston rod 7 connected to a hollow piston 8 is accomodated in the pump housing 5.

The hollow piston rod 7 is secured to a projection of the inner wall of the pump housing 5. A pump cylinder 9 is reciprocally movable over the hollow piston 8. The pump outlet 10 is connected to a flexible outlet tube 11 situated in the bent neck 2 of the outer container 1 and being connected to a spray nozzle 12 being mounted in a spray nozzle holder 13 at the end of the bent neck.

Moving the pump cylinder 9 reciprocally over the hollow piston 8 takes place with the help of a lever mechanism having a trigger 14 projecting through a trigger slot 15 in the outer container 1. This trigger 14 ends into a fork-shaped double lever 16 being secured in pivot points 17 to the inner wall of the outer container. The trigger 14 engages through a link-shaped engaging member 18 slid over a neck 19 of the pump cylinder. This neck is linked up with a pump inlet 20 being connected to a flexible suction tube 21 and extending to the reservoir housing 6 through an opening 22 in the partition wall 4. Owing to the advantageous power transmission of the trigger to the pump cylinder, an optimum pumping action is achieved.

In the reservoir housing 6 there is room for receiving a bag-shaped liquid packing 23 of flexible material, e.g. thermoplastic material, such as PE/PET, filled with a liquid or gel to be dispensed, and closed off by a connector 24 which is opened by sliding it onto a plug-shaped connector pin 25 mounted in a connector pin holder 26 which is linked up by the extremity of the suction tube 21.

On account of the fact, that the connector pin 25 is directed upwards at the bottom side of the outer container, the small bag 23 will come to lie upside down in the outer container, and on pumping through the pump 7, 8, 9, the contents of the vacuum-filled bag can easily and completely be pumped out, even when, as a result of becoming empty, the refill packing will collapse. The great advantage of this mounting method is that no special provisions, such as grooves or a small riser, need be made in the bag in order to prevent the bag from getting sucked shut, which will indeed be the case, when the bag would have been mounted with the connector upwards.

The rear side of the outer container, forming the cover 3, can easily be removed by means of a ball knob 27 fastened on a rod 28 extending through the cover 3 and having a screw or bayonet connection 29 with the holder. This ball knob, being positioned at the other side of the neck opposite the trigger also has the function of aid in handling of the dispenser, in which the palm of the hand will come to lie behind this knob and one can easily operate the trigger with the index finger in order to pump out liquid or gel. On the other hand, the trigger can also be operated by the thumb, which will considerably enhance the spraying facility with hair and deodorant spray, for example.

Figure 2:
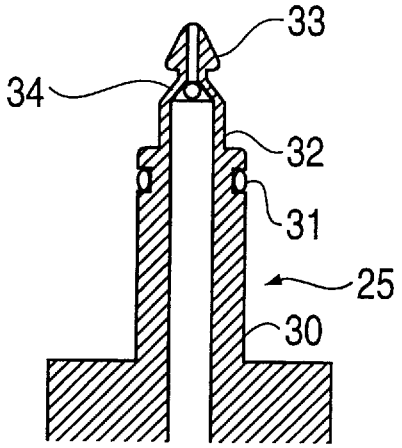
FIG. 2 shows on an enlarged scale in side view in section a connector pin to be used with it.

The connector pin 25 is shown in more detail in FIG. 2. It has a hollow connector tube 30 being provided with a groove with O-ring 31 at the outside. The front portion 32 has a smaller diameter and is bevelled at the front side. On this conical part there is a plug head 33 provided with a suitably chosen profile with barb-function, and lateral openings for passing liquid are provided immediately beneath this plug head.

Figure 3A:
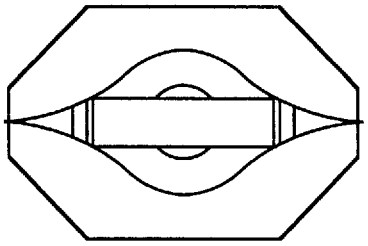
FIG. 3 shows on an enlarged scale in side view in section the connector of a flexible packing.
Figure 3B:
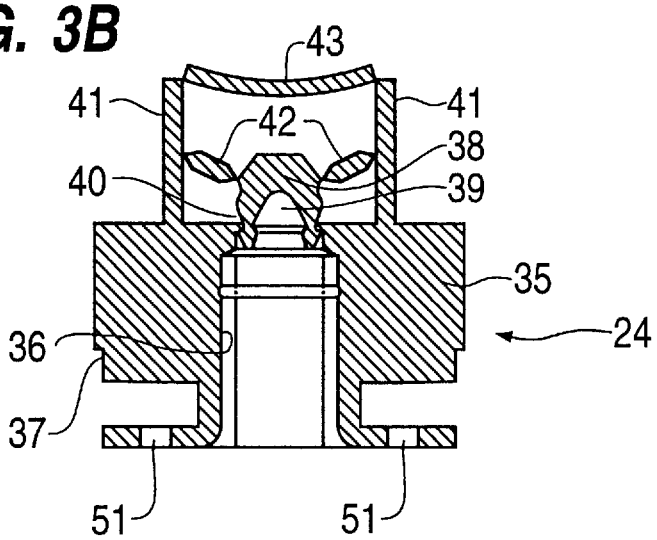

A preferred embodiment of the connector 24 of the refill packing 23 is shown in FIG. 3. This connector has a connector body 35 having a suitably chosen circumference, being round, hexagonal, etc., for example. This connector body 35 has a central throug-bore 36, in which the diameter is adjusted to that of the connector tube 30 of the connector pin 25. At the connector body circumference there is a mounting edge 37 to which the bag of the refill packing is welded or fastened otherwise. At the back side of the connector body 35, being in the mounted state within the refill bag 23, a sealing plug 38 provided with a cavity 39 can be inserted into the rear extremity, that is, the seat of the central bore 36. Said cavity has an internal profile being adjusted to the profile of the plug head 33 of the connector pin 25. At its outside, the plug 38 has a suitable sealing profile connecting to the profile of the seat.

Further, the rear end of the connector body 35 holds upstanding columns 41 projecting beyond the plug 38. Through pivot arms 42, the plug 38 is connected to the upstanding columns 41. The pivot arms 42 provide for guiding and limiting the movement of the plug 38 and for continuous connection of the plug 38 to the connector body 35 through the upstanding columns 41. Over the columns 41 there is a bridging rear edge 43 which is intended to prevent a refill bag from entering the connector and blocking it during pumping out said bag. To that end, this rear wall 43 can further be provided with lateral pins (not shown).

Figure 4:
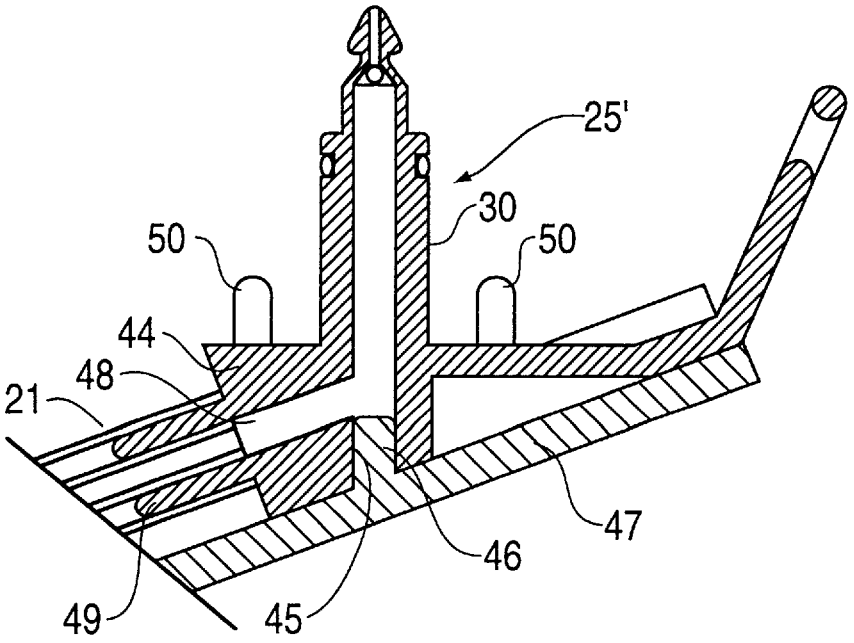
FIG. 4 shows in cross-section a second embodiment of the connector pin.

FIG. 4 shows a preferred variant of the connector pin shown in FIG. 2. Just like the connector pin in FIG. 2, the connector pin 25' in FIG. 4 has a connector tube 30, formed according to that of FIG. 2, having a connector tube groove with O-ring, narrowed front portion, profiled plug head and lateral openings.

In contrast to the embodiment of FIG. 2, the connector pin 25' is formed integrally with a fastening body 44 having a mounting cavity 45 at its bottom side, by means of which the connector pin can be stuck onto a projection 46 of the bottom 47 of the outer container. The internal channel of the connector tube 30 merges into an internal channel 48 extending laterally in the fastening body 44 and ends in a connection 49 communicating with the suction tube 21.

The fastening body 44 can be provided with mounting plugs 50 being suitably insertable in corresponding openings 51 in a front flange of the connector body 35 of the connector 24.

These plugs 50 and plug openings 51 efficiently form an orientation system for positioning the connector in the proper position. On the other hand, they can also form a key system in order to guarantee that only special refill packings can be used.

Figure 5A:
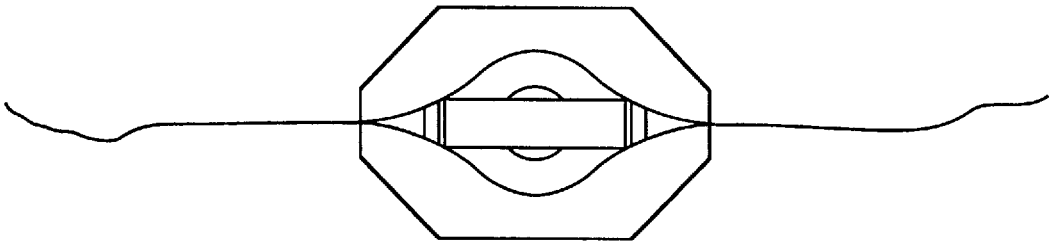
FIG. 5 shows the insertion of the connector pin into the connector in a first stage.
Figure 5B:
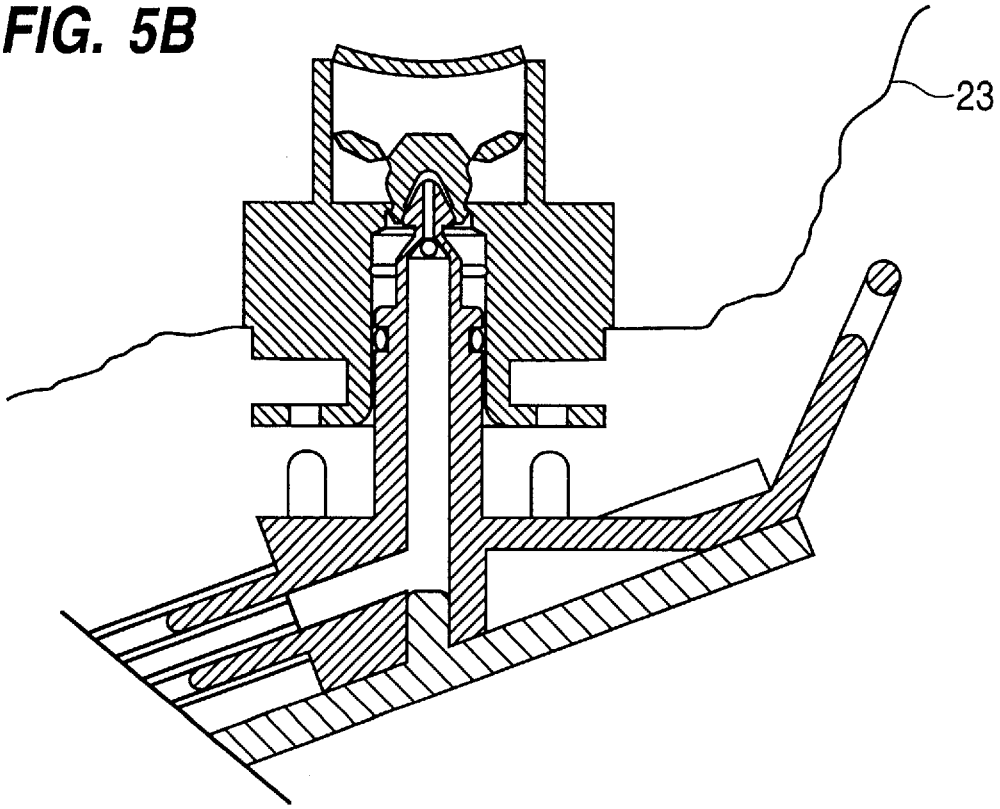
Figure 6A:
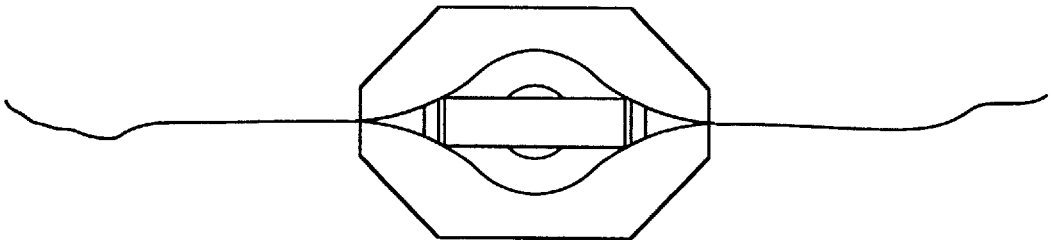
FIG. 6 shows the insertion of the connector pin into the connector in a second stage, in which the connector is still closed.
Figure 6B:
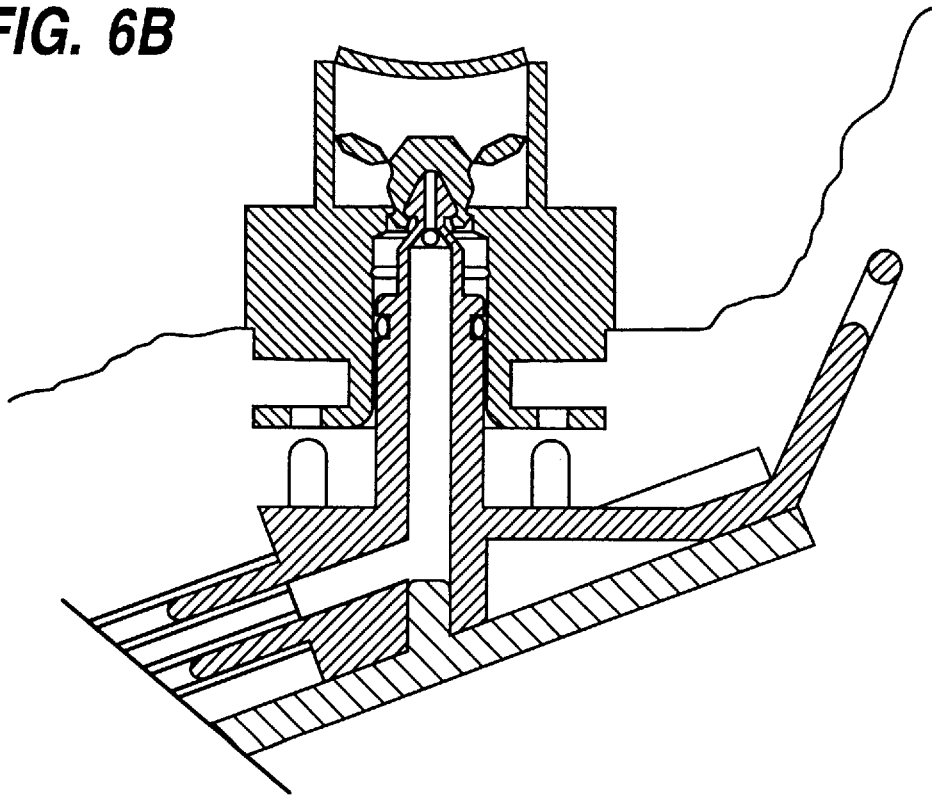
Figure 7A:
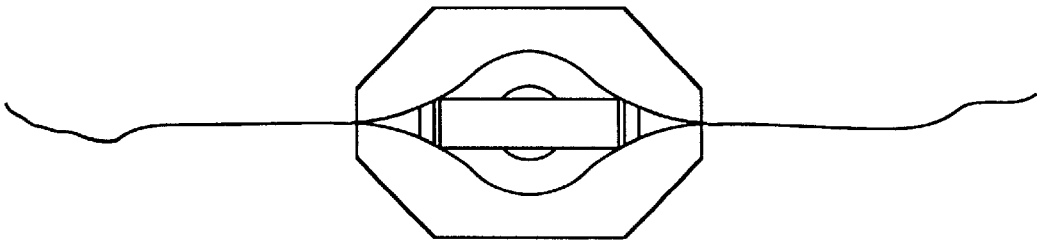
FIG. 7 shows the last stage of this insertion, in which the connector is opened.
Figure 7B:
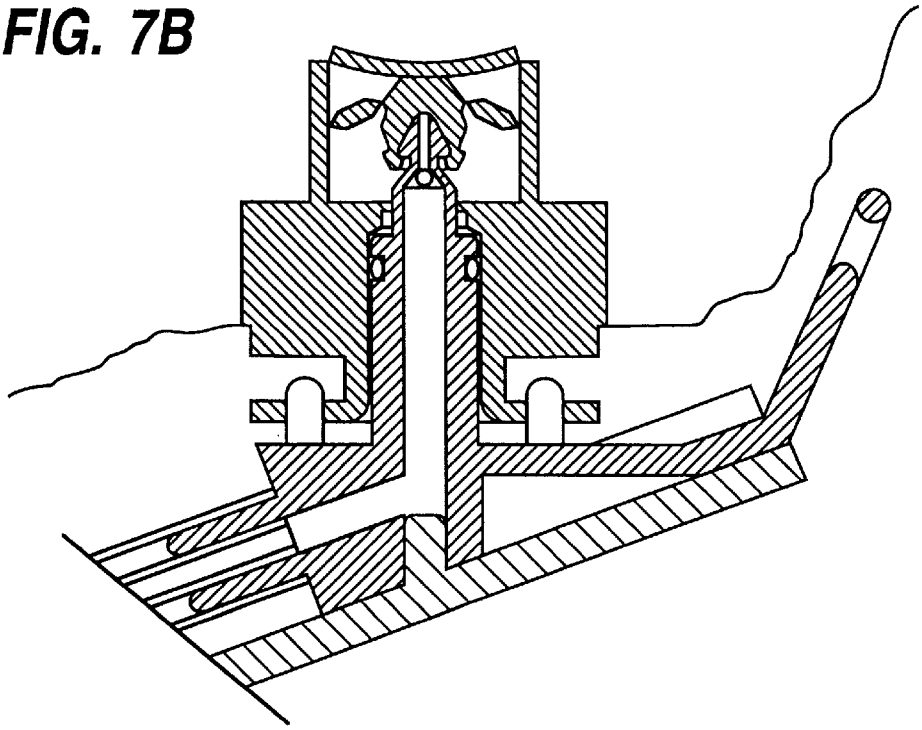
Figure 7C:
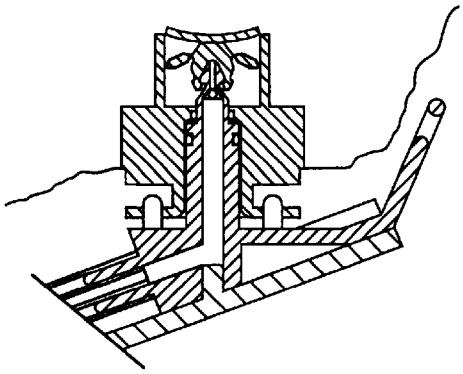

Connecting the connector 24 to the connector pin 25' will now be explained further by way of the FIGS. 5–7 showing three successive stages of connecting the connector to the connector pin.

In a first stage, shown in FIG. 5, one mounts the refill bag in the outer container 1 and presses the connector 24 onto the plug-shaped connector pin 25', in which the connector tube 30 of the connector pin penetrates the central bore 36 of the connector body 35. The plug head 33 penetrates into the plug cavity 39 of the plug 38 keeping the central bore 36 sealed. At that time, the connector is still closed and liquid can not leak. Then one pushes further, until the plug head 33 has completely penetrated the cavity 39 of the plug 38, in which the adjusted profiles of plug head 33 and cavity 39 provide a good grip.

By pushing through further, the plug 38 is pushed upward to its maximum position, determined by the length of the pivot arms 42. Now, the plug 38 has come free of the bore 36, so that through the lateral openings 34 liquid or gel from the refill packing can go to the pump through the connector. Here, the risk of undesired leakage is excluded at all times.

If one wishes to remove the refill bag, whether or not completely used, one acts in reverse order, that is, according to the stages of FIGS. 7, 6 and 5, so that the plug 38 returns to the starting position of FIG. 5, where a sealing closure between plug and connector bore is guaranteed.

It is important, that a liquid-tight seal between connector pin and connector bore is maintained, before the plug is pushed from the seat on connecting, and before the plug is engaged in the seat on uncoupling.

In the above, the invention was explained by way of one embodiment. However, it will be obvious, that numerous variations and changes are possible, all of them considered to be within the scope of the invention. Thus, a dispenser having a pressed-on spray nozzle like usual dispensers is conceivable, in which however the bottom folds out and has its inside provided with the connector pin, which in turn is connected to the pump through a flexible hose. In order to mount a refill packing, the dispenser bottom is folded out, the refill packing with its connector is stuck onto the connector pin, and then the cover is closed again, whereupon the dispenser is ready for use. The great advantage of this type of dispenser is that it can be manufactured by blowing suitable plastic material (instead of the more expensive injection moulding), whereupon the bottom is pushed out in such a way, that it remains pivotably connected at one side. Subsequently, the connector pin can be mounted on this bottom.

Further, the connector system according to the invention is suitable for more applications than only the ones described above. Thus, such a connector system can be used for bag-in-box, cartridge and drip systems (blood transfusion), for example, and numerous other applications. More generally, the connector system according to the invention can be applied for leakage-free connecting and uncoupling of spaces filled with gaseous, liquid or granular and powdered media. Further, the connector pin is also suitable as filling pin of a filling system for refill bags, in which the filling pin of the filling system can be designed as the embodiment of FIG. 2. Owing to the self-closing connector structure, in which the connector is immediately closed again after filling and removing the refill bag, no sealing cap need be fitted after filling.

Further, the plug head of the connector pin can efficiently be provided with a fine, central bore, or with axial circumferential grooves, to guarantee that the plug can be inserted into the plug cavity of the connector body without difficulty.

After having read the above, further variations and combinations will be clear to the expert.

We claim:

1. A liquid dispenser with refill packing, comprising:

an openable outer container of rigid material and provided with a pump;

a nozzle connected to the pump at a delivery side of the pump and a connector tube connected to the pump at an intake side of the pump, the connector tube having a hollow pin construction which narrows at an extremity thereof;

an inner container of flexible material in the form of a flexible refill packing for dispensing a liquid;

a plug member closing off the inner container, connectable to the connector tube, and including a connector body having a central bore into which the connector tube is insertable;

a plug head formed in the extremity of the connector tube such that lateral openings in a wall of the extremity are provided adjacent the plug head;

a seat formed in a rear end of the central bore, into which a plug can be inserted to close the rear end of the bore, the plug having a cavity into which the plug head of the connector tube fits; and guide arms connecting the plug to the connector body and fixing the plug in an open position.

2. The liquid dispenser as claimed in claim 1, wherein the pump comprises an externally openable dispenser pump.

3. The liquid dispenser as claimed in claim 1, wherein the pump comprises an atomizing pump.

4. The liquid dispenser as claimed in claim 1, wherein the connector body further comprises upstanding columns at a back side thereof which extend beyond the plug and are connected at their free ends to a rear edge.

5. The liquid dispenser as claimed in claim 4, wherein the rear edge is provided with lateral pins arranged to prevent the refill packing from being sucked into the connector during a pumping operation.

6. The liquid dispenser as claimed in claim 4, wherein the plug is connected to the upstanding columns by the guide arms.

7. The liquid dispenser as claimed in claim 1, wherein the connector body further comprises a mounting edge, for mounting the connector body to the inner container.

8. The liquid dispenser as claimed in claim 1, wherein the connector tube further comprises a circumferential groove into which an O-ring is fitted.

9. The liquid dispenser as claimed in claim 1, wherein the connector tube is mounted in the outer container at a bottom side thereof, with the plug head extending in an upward direction for connection to the pump through a flexible hose.

10. The liquid dispenser as claimed in claim 1, further comprising an outlet nozzle, wherein the outer container further includes an outlet branch integrally formed therewith, and the pump is positioned in a protected space of the outer container and is connected to the outlet nozzle through the outlet branch.

11. The liquid dispenser as claimed in claim 10, wherein the pump comprises:

a piston pump having a hollow piston rod with a hollow piston connected to the outlet nozzle, and a pump cylinder reciprocally movable over the piston rod, and being operated by a fork-shaped lever inserted into an engaging member, a fork-shaped end of the lever being pivotally mounted on opposite walls of the outer container.

12. The liquid dispenser as claimed in claim 11, further comprising a trigger including a stem protruding through a slot in a wall of the outer container from an interior of the dispenser to an exterior of the dispenser.

13. The liquid dispenser as claimed in claim 12, wherein the outer container has a cover and a locking knob provided near the outlet branch when the cover is closed to guide efficient operation of the trigger by an operator's hand during use of the dispenser.

14. A connector system for leak-free connection to spaces filled with gaseous, liquid, granular or powdered media, the connector system comprising:

a connector tube having a hollow pin construction with an extremity, the extremity including a plug head and lateral openings extending through a wall of the extremity adjacent the plug head;

a plug member including a connector body having a central bore which can be closed at a rear end thereof by a plug inserted into a seat formed in the rear end, the plug having a cavity into which the plug head is adapted to fit; and guide arms which connect the plug to the connector body and fix the plug in an open position.

15. A connector system as claimed in claim 14, wherein the connector tube and the plug member are manufactured as a single piece.

16. A refill packing for connection to a liquid dispenser having a connector tube constructed as a hollow pin with an extremity onto which a plug head is formed, the refill packing comprising:

a plug member including a connector body having a central bore which can be closed at a rear end thereof by a plug inserted into a seat formed in the rear end, the plug having a cavity into which the plug head of the connector tube is adapted to fit.

* * * * *